US005386353A

United States Patent [19]

Battaglia

[11] Patent Number: 5,386,353

[45] Date of Patent: Jan. 31, 1995

[54] ELECTRIC LIGHTING SYSTEM

[76] Inventor: Domenic Battaglia, 70 Delta Park Blvd., Brampton, Ontario, Canada, L6T

[21] Appl. No.: 19,282

[22] Filed: Feb. 18, 1993

[30] Foreign Application Priority Data

Feb. 20, 1992 [CA] Canada ..... 2061573

[51] Int. Cl.[6] ..... F21S 3/02

[52] U.S. Cl. ..... 362/224; 362/222; 362/260; 362/457

[58] Field of Search ..... 362/147, 151, 217, 219, 362/260, 223, 218, 221, 222, 224, 237, 457, 458

[56] References Cited

U.S. PATENT DOCUMENTS

| | | | |
|---|---|---|---|
| 1,042,587 | 10/1912 | Moore | 362/219 |
| 2,569,518 | 10/1951 | Deutsch et al. | 362/151 |
| 2,643,328 | 6/1953 | Elmendorf | 362/224 |
| 2,988,633 | 6/1961 | Rosenfield | 362/219 |
| 3,120,929 | 2/1964 | Henning | 362/219 |
| 3,319,059 | 5/1967 | Ogden | 362/219 |
| 3,428,799 | 2/1969 | Bassani | 362/219 |
| 3,436,537 | 4/1969 | Bostonian | 362/219 |
| 4,092,562 | 5/1978 | Campbell | 362/221 |
| 4,413,311 | 11/1983 | Orenstein | 362/147 |
| 4,420,798 | 12/1983 | Herst et al. | 362/147 |
| 4,712,165 | 12/1987 | Cetrone | 362/147 |
| 4,858,087 | 8/1989 | Hartshorn | 362/219 |

FOREIGN PATENT DOCUMENTS

| | | | |
|---|---|---|---|
| 560802 | 4/1944 | United Kingdom | 362/224 |

*Primary Examiner*—Ira S. Lazarus
*Assistant Examiner*—Alan B. Cariaso

[57] ABSTRACT

An electrical lighting system consists of two or more, adjacently mounted, lighting modules where each module includes an elongated, box-type housing adapted to be mounted in a predetermined arrangement on a light source supporting surface, the housing being provided with mounting and electrical supply for a light source and, further, with longitudinal guides mounted on the sides of the box and adapted to accept and secure a slotted tubular translucent light cover when the slot edges of the tubular cover are slid into the guides and split collars providing slide-in openings adapted to accommodate the ends of two or more of the covers of the adjacently mounted lighting modules.

6 Claims, 1 Drawing Sheet

ELECTRIC LIGHTING SYSTEM

BACKGROUND OF THE INVENTION

1. Field of the Invention

This invention relates to lighting systems and more particularly to decorative lighting systems designed to provide wide and even lighting of a room such as a kitchen. The invention comprises, preferably, fluorescent tube type lighting modules which are, in themselves, individual drop lighting modules. The invention, however, should not be considered as limited to kitchen use as it is adaptable to a wide range of room configurations and sizes since the basic lighting modules may be combined to form a wide variety of integrated lighting configurations.

2. Prior Art

Drop ceiling lighting arrangements are in wide use, particularly for kitchen lighting. Such arrangements commonly take the form of a full area drop ceiling with inserted translucent panels behind which are placed fluorescent tube type lighting arrangements. The ceilings may, of course be fully translucent but, normally, such an arrangement will provide too high light intensity.

U.S. Pat. No. 4,712,165, Cetrone, issued Dec. 8, 1987, discloses an integrated system of fluorescent tube Lighting units each of which comprise a slotted plastic surround tube incorporating therein a fluorescent lighting system comprised by a fluorescent tube and appropriate ballast. The integrated system uses T and angle couplings which are suspended, by rods or rubes, from the ceiling per se. The lighting units according to this patent suffer from the disadvantage that the system cannot be considered decorative in view of the slotted tube system and, furthermore, is difficult to assemble or service since the supports in an integrated system are interdependent and removing a support for one unit will render the support insufficient or unstable for one or more adjacent units.

U.S. Pat. Nos. 4,096, Taylor, issued Jun. 20, 1978 and 4,413,311, Orenstein, issued Nov. 1, 1983 show other forms of integrated lighting systems using modules However, these systems are complex, expensive to produce and install and not subject to wide usage.

OBJECTS OF THE INVENTION

It is a prime object of the present invention to provide a decorative drop ceiling type lighting system which is adaptable to many configurations, inexpensive to produce and install.

A further object of the invention is to provide lighting modules which are individually supportable whether mounted singly or in an integrated system and which can be pre-assembled off-site, for the most part, so that on-site labour is minimized.

It is a still further object of the invention to provide couplings and terminations for the modules which are supported by the modules rendering assembly of integrated systems low-labour intense.

SUMMARY OF THE INVENTION

The present invention is based on the provision of basic lighting modules, preferably of the fluorescent tube type, which use standard ballast housings and mounting systems i.e. where the module is secured to a ceiling or wall surfaces by fastening the housings to the surface by means of screws or other types of fasteners.

The housing is provided with side channels, or other similar means, into which a translucent, and preferably decorative, cover can be slid after the housing is mounted on the surface. Further modules can be mounted in line or at an angle as desired with respect to the first and an appropriate coupling slid onto the end of the first cover and into which the cover of a further module may be slid to form an integrated system. Versatile couplings are provided for in-line or angled joining of modules. Termination or end covers are also provided to give a finished appearance to the system.

DETAILED DESCRIPTION OF THE INVENTION

Figure 1:
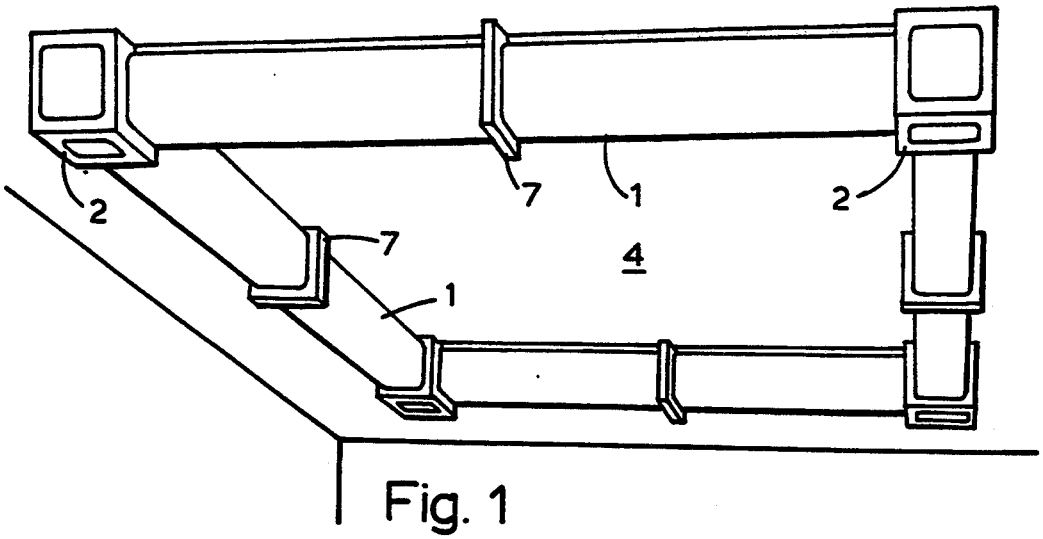
FIG. 1 shows an integrated drop ceiling lighting system, according to the invention, in a simple rectangular configuration.
Figure 2:
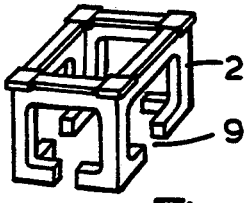
FIG. 2 shows a coupling for lighting modules which may be used for in-line or angled coupling.
Figure 3:
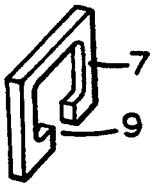
FIG. 3 shows a simplified in-line coupling.
Figure 5:
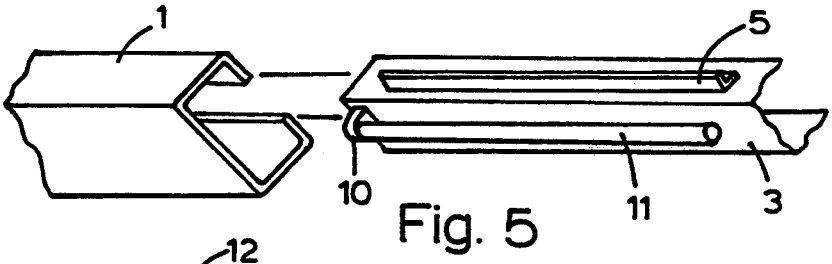
FIG. 5 shows an exploded view of a module and cover illustrating a means of assembling a translucent cover with a basic fluorescent tube lighting system with ballast housing.
Figure 6:
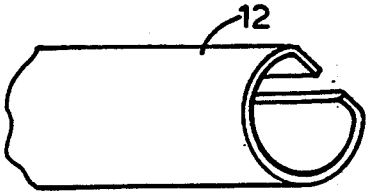
FIG. 6 shows an alternate form of translucent cover.

Referring to FIG. 1 of the drawings a lighting assembly, according to the present invention, is shown mounted on the ceiling of a room, a kitchen for instance. The assembly configuration shown is comprised by four drop ceiling type modules connected end to end to form a square configuration. With reference to FIG. 5, each module consists of a fluorescent lamp ballast housing 3 in the form of a long, low silhouette, rectangular box, provided with a lamp ballast within, not shown, and provided, further, with electrical connection bases 7, only one of which is shown, for supporting a tubular fluorescent lamp 11. It will be obvious that the use of more than one lamp per ballast would be employed if greater light intensity is required. Also the length of lamp may be, for instance, two-foot, four-foot or eight-foot etc.

The ballast housing 3 is provided with a slide on translucent and decorative lamp cover 1, in the form of a longitudinally slotted tube, which is supported on the ballast housing by means of side guide flanges 5, only one of which is shown. Alternatively channels or other suitable guide means can be used instead of the flanges 5. A feature of the invention is that the translucent cover can be slid axially onto the ballast housing after the ballast has been secured onto a supporting ceiling, for instance. The translucent cover can take many forms, round oval and rectangular in cross-section, for instance, and may be provided with internal or external decorative and/or light dispersing coatings or the surface may be pebbled or otherwise contoured as desired.

In order to couple lighting modules into an integrated assembly, a corner box or coupling 2 is employed. Although it may take many forms the rectangular box configuration is preferred since it is able to provide for right-angle or end-to-end coupling and thus allows assembly of a system which can be readily fitted to a variety of irregular room configurations.

As is best seen in FIG. 1, the corner couplings 2, presenting split ring side face configurations, which fit snugly around the end of a lighting module, the slot 9 in the coupling being dimensioned to fit over the ends of a translucent cover and the ballast housing after the housing has been mounted on a ceiling, for instance. If sufficient end play is allowed in the couplings the translucent covers of adjacent coupled modules can be moved away from one end coupling so that that end coupling can be removed or replaced. This feature also provides the opportunity to then slide a cover in the opposite direction and remove it completely from the ballast housing in order to change a lamp, for instance.

If it is desired to couple lighting modules in end to end and axial relationship a split ring 7 can be used to maintain translucent cover alignment and, at the same time, stop light leakage between the ends of adjacent covers.

Figure 4:
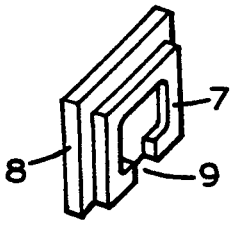
FIG. 4 shows an end cover for a module.

If it is desired to close off the end of a module, a combination split ring end-plate 8, shown in FIG. 4, can be utilized.

The configurations of the openings in the couplers or the end plate combination are varied to accommodate the particular tubular cross-section configuration of the translucent cover employed.

Furthermore, the light source employed can be varied, although for energy conservation fluorescent type lamps are preferred.

It will be obvious to those skilled in the lighting field that the invention provides a lighting system which is versatile in configuration, economical in construction and low labour intensive for on site installation.

I claim:

1. An electric lighting system comprising an arrangement of individual lighting modules adapted to be mounted on a supporting surface, each lighting module comprising a housing having an elongated rectangular shape and being adapted to be directly mounted on said supporting surface, each said housing including a tubular fluorescent lamp ballast and lamp base connection supports for a fluorescent lamp, the long sides of said housing being provided with outward facing guide means mounted longitudinally along the long sides and parallel to the supporting surface, an elongated tubular translucent cover for the fluorescent lamp, the cover defining a longitudinally extending slot having edges being slidable along the guide means to support the cover relative to the fluorescent lamp, first split collar means mounted on the cover and being freely slidable therealong to provide overlapping coupling between opposed ends of the covers of two adjacently mounted modules arranged in an end-to-end relationship, and second split collar means integral with said first split collar means and arranged angularly with respect thereto, said second split collar means providing overlapping connection between the covers of two or more adjacently mounted lighting modules arranged in end-to-end angular relationship with respect to each other to form an integrated lighting system.

2. An electrical lighting system comprising lighting modules adapted to be mounted on a supporting surface, each lighting module comprising, an elongated rectangular shaped housing including a ballast transformer for at least one connection and support means mounted on said housing, a longitudinally extending guide means mounted on each long side of said housing parallel to the supporting surface, an elongated translucent lamp cover slidably secured to the housing by the guide means, the cover defining a longitudinal slot having edges cooperatively engaging the guide means to secure the cover to the housing in a suspended relationship, and split collar means mounted on the cover and being freely slidable longitudinally along the cover to provide an overlapping coupling between opposed ends of the covers of two or more adjacently mounted lighting modules arranged in end-to-end, angular relationship relative to each other.

3. The electrical lighting system of claim 1, wherein said second split collar means provides overlapping connection between the covers of four adjacently mounted lighting modules arranged in an end-to-end, right-angular relationship relative to each other.

4. The electrical lighting system of claim 2, wherein said split collar means provides overlapping connection between the covers of four adjacently mounted lighting modules arranged in an end-to-end, right-angular relationship relative to each other.

5. The electrical lighting system of claim 3, further comprising means for closing open ends of the lighting modules.

6. The electrical lighting system of claim 4, further comprising means for closing open ends of the lighting modules.

* * * * *